US012582192B2

(12) United States Patent
Wang et al.

(10) Patent No.: US 12,582,192 B2
(45) **Date of Patent: *Mar. 24, 2026**

(54) FOOTWEAR STRAP AND FOOTWEAR HAVING THE SAME

(71) Applicant: Skechers U.S.A., Inc. II, Manhattan Beach, CA (US)

(72) Inventors: Eric Chi Chiang Wang, Redondo Beach, CA (US); Wanling Cheng, Taichung City (TW); Hui Xie, Dongguan City (CN)

(73) Assignee: Skechers U.S.A., Inc. II, Manhattan Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/047,591

(22) Filed: Feb. 6, 2025

(65) Prior Publication Data

US 2025/0176657 A1 Jun. 5, 2025

Related U.S. Application Data

(63) Continuation of application No. 18/438,492, filed on Feb. 11, 2024, now Pat. No. 12,268,280.

(30) Foreign Application Priority Data

Jul. 19, 2023 (CN) ..... 202321904385.5

(51) Int. Cl.
*A43B 11/00* (2006.01)
*A43B 3/12* (2006.01)
(Continued)

(52) U.S. Cl.
CPC ..... *A43B 3/126* (2013.01); *A43B 3/122* (2013.01); *A43B 11/00* (2013.01); *A43B 11/02* (2013.01); *A43B 23/088* (2013.01)

(58) Field of Classification Search
CPC ..... A43B 11/00; A43B 11/02; A43B 23/088; A43B 3/126; A43B 3/122; A43B 23/08
(Continued)

(56) References Cited

U.S. PATENT DOCUMENTS 256,030 A * 4/1882 Morton ..... A43B 23/16 36/68
2,466,139 A * 4/1949 Waugh ..... A43B 3/126 12/116.8
(Continued)

FOREIGN PATENT DOCUMENTS

CN 107404966 11/2017
CN 113453577 9/2021
(Continued)

OTHER PUBLICATIONS

Examination Report for AU2024203569 dated Apr. 4, 2025.
(Continued)

*Primary Examiner* — Marie D Bays
(74) *Attorney, Agent, or Firm* — Marshall A. Lerner; Steven J. Kim; Daniel J. Malkin

(57) ABSTRACT

Embodiments of the present application provide a footwear strap and a footwear having the same. An article of footwear may have a strap element and a heel structural element inside the strap element. The heel structural element may have two connecting arms, each of the two connecting arms having a medial arm and a lateral arm connected with the medial arm. The lateral arm and the medial arm may be integrally molded, and the lateral arm may be connected with the upper rear portion. The footwear strap may be assembled to the footwear and a compressible layer is located on an inner side of the heel structural element, and the compressible layer entirely covers the upper rear portion, at least partially covers the medial arm and the lateral arm,
(Continued)

and gradually tapers or terminates along the inner side of the medial arm and the inner side of the lateral arm.

22 Claims, 7 Drawing Sheets

(51) Int. Cl.
*A43B 11/02* (2006.01)
*A43B 23/08* (2006.01)

(58) Field of Classification Search
USPC ..... 36/11.5, 69, 138
See application file for complete search history.

(56) References Cited

U.S. PATENT DOCUMENTS 3,081,561 A * 3/1963 Taicher ..... A43B 23/0275 36/105
4,608,769 A * 9/1986 Sturlaugson ..... A43B 11/00 36/51
4,642,916 A * 2/1987 Collins ..... A43B 23/08 36/58.6
5,012,596 A * 5/1991 Schiller ..... A43B 13/146 36/11.5
5,787,608 A * 8/1998 Greenawalt ..... A61F 5/14 36/169
5,901,394 A * 5/1999 Greenawalt ..... A43B 7/28 36/11.5
6,256,906 B1 * 7/2001 Matis ..... A43B 3/126 36/11.5
6,684,533 B1 * 2/2004 Su ..... A43B 11/00 36/105
10,568,385 B2 2/2020 Beers et al.
10,617,174 B1 * 4/2020 Hopkins ..... A43B 23/027
10,638,810 B1 * 5/2020 Cheney ..... A43B 3/248
11,344,077 B2 * 5/2022 Hopkins ..... A43B 11/02
12,268,280 B2 * 4/2025 Wang ..... A43B 3/126
2002/0066213 A1 * 6/2002 Wells ..... A43B 3/0084 223/118
2003/0074806 A1 * 4/2003 Urie ..... A43B 3/126 36/11.5
2003/0182820 A1 * 10/2003 Fuerst ..... A43B 1/0027 36/11.5
2013/0185959 A1 * 7/2013 Coleman ..... A43B 11/00 36/107
2015/0196095 A1 * 7/2015 Chapman ..... A43C 11/1493 36/58.6
2016/0374427 A1 * 12/2016 Zahabian ..... A43B 3/24 36/102
2018/0110292 A1 * 4/2018 Beers ..... A43B 11/02
2018/0289109 A1 * 10/2018 Beers ..... A43B 11/00
2020/0046062 A1 * 2/2020 Perillo ..... A43B 3/12
2020/0205517 A1 * 7/2020 Happen ..... A43B 11/02
2020/0205518 A1 7/2020 Hopkins et al.
2020/0253333 A1 * 8/2020 Kilgore ..... A43B 3/0063
2021/0010609 A1 * 1/2021 Liu ..... F16K 11/074
2021/0068494 A1 * 3/2021 Zahabian ..... A43B 11/00
2022/0240625 A1 * 8/2022 Shin ..... A43B 23/028
2023/0033366 A1 * 2/2023 Farina ..... A43B 21/30
2023/0284748 A1 * 9/2023 Weeks ..... A43B 23/088
2024/0008593 A1 * 1/2024 Hatano ..... A43B 11/02

FOREIGN PATENT DOCUMENTS

CN 114304807 4/2022
GB 701936 1/1954
TW M553945 1/2018

OTHER PUBLICATIONS

Resolution 54180 Colombia NC20230015926 dated Aug. 6, 2025.
Technical Evaluation Report for TW113205415 dated Aug. 11, 2025.
Office Action CH202402117 dated Jul. 2, 2025.

* cited by examiner

FOOTWEAR STRAP AND FOOTWEAR HAVING THE SAME

CROSS-REFERENCE TO RELATED APPLICATION

This application is a continuation of U.S. patent application Ser. No. 18/438,492, titled "FOOTWEAR STRAP AND FOOTWEAR HAVING THE SAME" and filed Feb. 11, 2024, which claims priority to Chinese patent application No. CN2023-21904385.5 and filed Jul. 19, 2023. Both of the aforesaid applications, in their entirety, are incorporated by reference herein.

TECHNICAL FIELD

The present application relates to the technical field of footwear, in particular to a footwear strap and footwear having the same.

BACKGROUND

A footwear strap is generally provided on footwear such as sandals, so as to secure the heel part to footwear. The footwear strap needs to be designed, not only to fit the heel and firmly be affixed to the footwear, but also to facilitate a wearer to put on and take off the footwear. Therefore, the design of the footwear strap plays an important role in the use and wearing of the footwear.

SUMMARY

Embodiments of the present application provide a footwear strap and footwear having the same to improve the comfort and convenience of putting on and taking off the footwear.

In the first aspect, an embodiment of the present application provides a footwear strap, which comprises a strap element and a rigid heel structural element; wherein the rigid heel structural element is disposed inside the strap element, and the rigid heel structural element comprises an upper rear portion; when the footwear strap is assembled to footwear, the upper rear portion extends in a direction from the position where the footwear contacts the heel toward of the position where the footwear contacts the toe, and inclines downward of the footwear; the upper rear portion has a convex curvature which is adapted to the shape of the heel so as to facilitate to easily receive the heel; when the footwear strap is assembled to the footwear, an inner lower portion of the convex curvature faces an opening of the footwear.

In one implementation, the rigid heel structural element comprises two connecting arms.

In one implementation, the connecting arms comprises a medial arm and a lateral arm connected with the medial arm, the lateral arm and the medial arm are integrally molded, and the lateral arm is connected with the upper rear portion.

In one embodiment, when the footwear strap is assembled to the footwear, the lateral arm extends downward to a footbed, insole or strobel sock of the footwear; the medial arm extends downward to the footbed, insole or strobel sock of the footwear.

In one embodiment, when the lateral arm extends downward to the insole of the footwear, the lateral arm is directly or indirectly affixed to the top surface of a sole along the medial side of the insole of the footwear; when the medial arm extends downward to the insole of the footwear, the medial arm is directly or indirectly affixed to the top surface of the insole along the lateral side of the insole of the footwear.

In one embodiment, when the lateral arm and the medial arm extend downward to the footbed of the footwear, the end of the lateral arm and the end of the medial arm are attached to the footbed of the footwear.

In one implementation, when the lateral arm and the medial arm extend downward to the strobel sock of the footwear, the end of the lateral arm and the end of the medial arm are attached to the strobel sock of the footwear.

In one implementation, the rigid heel structural element is made of a polymer material.

In one implementation, the polymer material is Hytrel thermoplastic polyester elastomer block copolymer or thermoplastic polyurethane.

In one implementation, the rigid heel structural element is covered by a fabric, textile material, leather, or polyurethane or other known polymer plastics in the art.

In one implementation, a compressible layer is provided on the inner side of the rigid heel structural element; the compressible layer covers the upper rear portion, partially covers the medial and lateral arms, and gradually tapers or terminates along the inner side of the medial arms and the inner side of the lateral arms.

In one implementation, the convex curvature has an upper surface that faces upward.

In the second aspect, an embodiment of the present application provides a footwear, comprising the footwear strap provided according to any embodiment of the present application. The shoe provided by the embodiment of the present application can be a sandal, or a leather shoe, a cloth shoe, a sports shoe and the like with heel straps.

In one implementation, the rigid heel structural element is connected to a footbed or insole of the shoe through an L-shaped anchor.

The above summary is for illustrative purpose only and is not intended to limit the present application in any way. In addition to the illustrative aspects, implementations and features described above, further aspects, implementations and features of the present application will be readily apparent by referring to the drawings and the following detailed description.

BRIEF DESCRIPTION OF THE DRAWINGS

In the drawings, unless otherwise specified, the same reference numerals indicate the same or similar components or elements throughout several drawings. These drawings are not necessarily drawn to scale. It should be understood that these drawings depict only some implementations disclosed in accordance with the present application and shall not be deemed as limiting the scope of the present application.

DETAILED DESCRIPTION

In the following text, only certain exemplary embodiments are briefly described. As can be recognized by those skilled in the art, the described embodiments can be modified in various different ways without departing from the spirit or scope of the present application. Accordingly, the drawings and the description are to be regarded as illustrative and non-limiting in nature.

Hereinafter, a rigid heel structural element 100 included in a footwear strap according to an embodiment of the present application will be described with reference to FIGS. 1A-1C, 2 and 3A-3D.

Figure 1A:
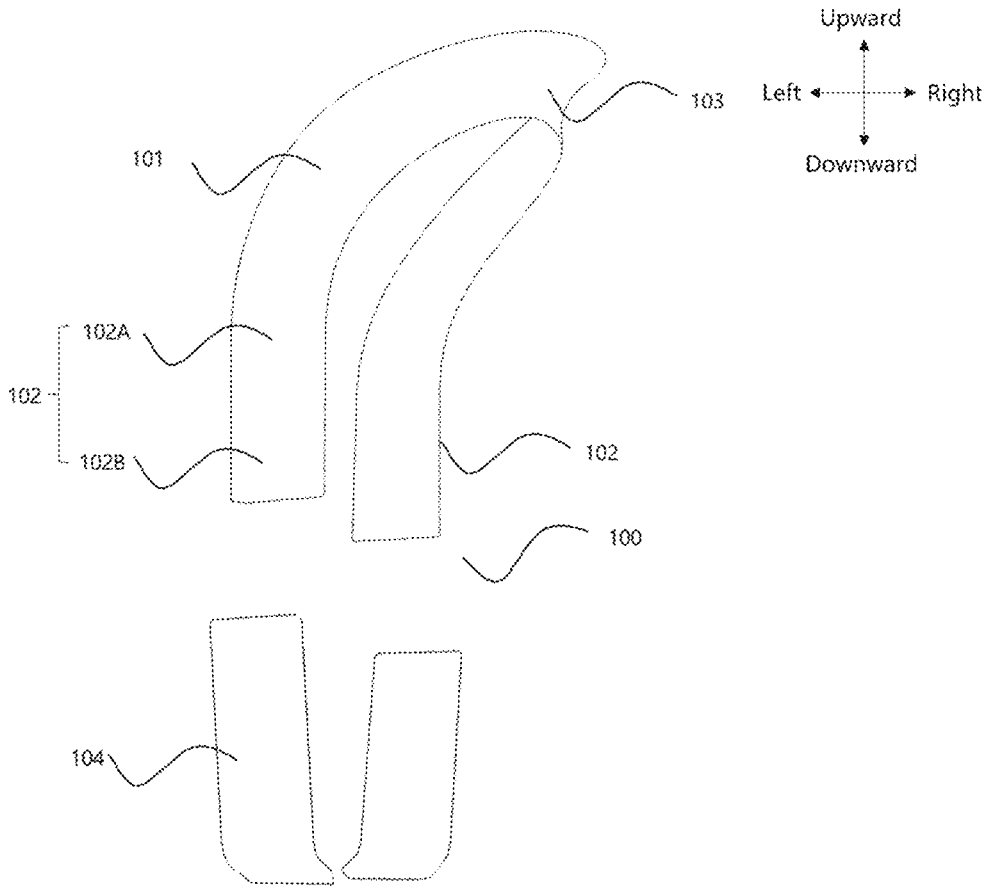
FIG. 1A shows a three-dimensional schematic diagram of a rigid heel structural element according to a first embodiment of the present application.
Figure 1B:
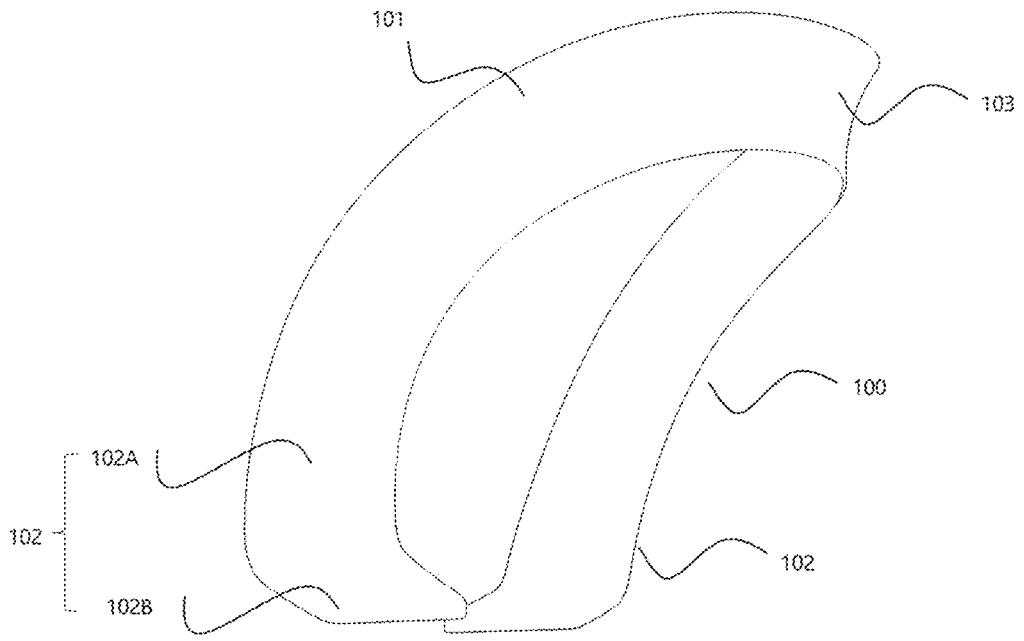
FIG. 1B shows a three-dimensional schematic diagram of a rigid heel structural element according to a second embodiment of the present application.
Figure 1C:
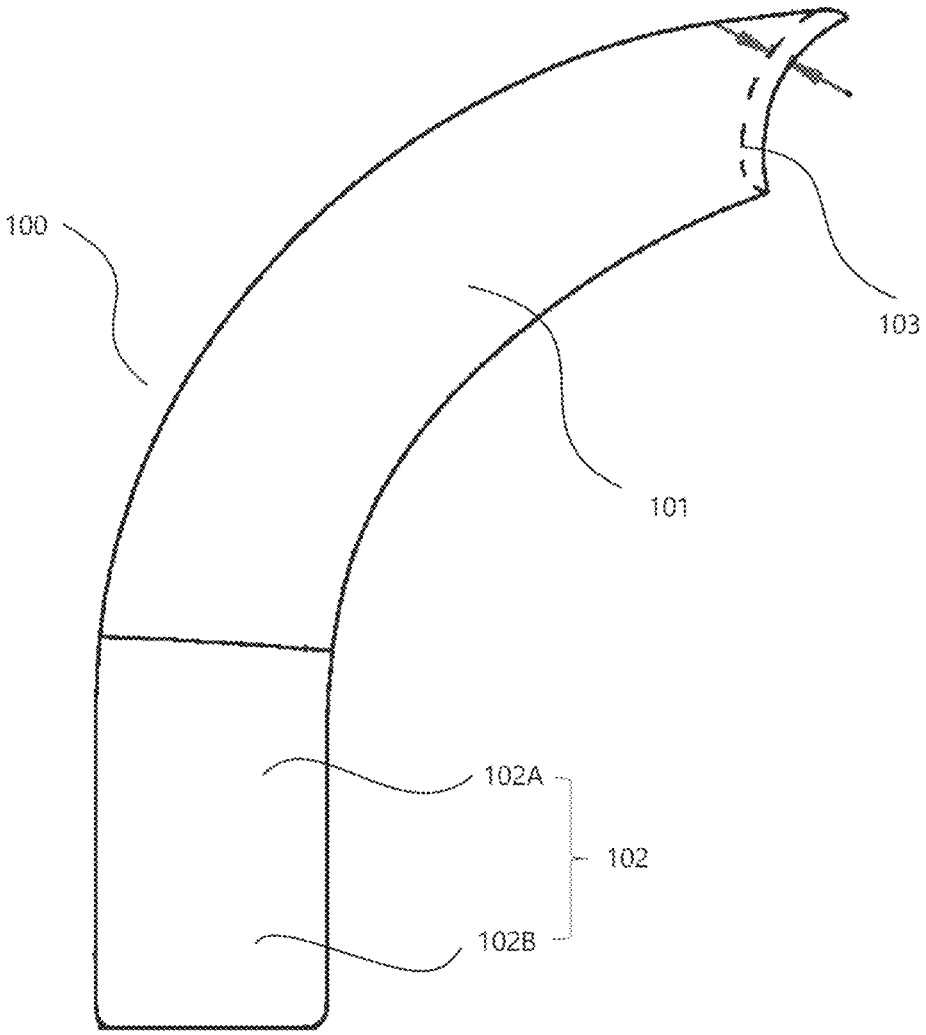
FIG. 1C shows a schematic diagram of a cross-section of a cross-section of the rigid heel structural element according to the first embodiment of the present application.

As shown in FIGS. 1A-1C, the footwear strap includes a strap element (not shown in FIGS. 1A-1C) and a rigid heel structural element 100. Among others, the strap element can be a fabric or textile material that wraps the rigid heel structural element 100. The rigid heel structural element 100, disposed inside the strap element, is configured to be structures and materials which facilitate easily inserting the foot into the footwear and bear the pressure from the foot, so as to prevent the rigid heel structural element 100 from collapsing under the pressure of the foot. Referring to FIGS. 1A and 1B, FIG. 1A shows a three-dimensional schematic diagram of a rigid heel structural element according to a first embodiment of the present application. Specifically, FIG. 1A shows a left side perspective view of the rigid heel structural element 100 according to the first embodiment of the present application. As shown in FIG. 1A, the rigid heel structural element 100 consists of a first part and a second part, wherein the first part includes an upper rear portion 101, a connecting arm 102 and a convex curvature 103, and the second part is an L-shaped anchor 104. The connecting arm 102 is connected with the upper rear portion 101. The connecting arm 102 includes a lateral arm 102A and a medial arm 102B, wherein both the lateral arm 102A and the medial arm 102B are arranged substantially in the lateral direction. The connecting arm 102 can be connected to the L-shaped anchor 104. As can be seen from FIG. 1A, the aforesaid four parts 101 to 104 are generally arranged in the order from the upper right direction to the lower left direction.

FIG. 1B shows a three-dimensional schematic diagram of a rigid heel structural element according to a second embodiment of the present application. The difference between the rigid heel structural element of the second embodiment and the rigid heel structural element of the first embodiment is that the connecting arm of the rigid heel structural element in the second embodiment itself is L-shaped. Specifically, FIG. 1B shows a left side perspective view of the rigid heel structural element 100 according to the second embodiment of the present application. As shown in FIG. 1B, the rigid heel structural element 100 includes an upper rear portion 101, a connecting arm 102, and a convex curvature 103. The connecting arm 102 is L-shaped. The connecting arm 102 is connected with the upper rear portion 101. The connecting arm 102 includes a lateral arm 102A and a medial arm 102B, wherein the medial arm 102B is substantially orthogonal to the lateral arm 102A.

In an implementation, the lateral arm 102A and the medial arm 102B can be integrally formed. In another alternative implementation, the lateral arm 102A and the medial arm 102B can be assembled or connected together after being manufactured separately.

FIG. 1C shows a schematic diagram of a cross-section of a first part of the rigid heel structural element of the first embodiment. As shown in FIG. 1C, the first part of the rigid heel structural element 100 includes an upper rear portion 101, a connecting arm 102 and a convex curvature 103. The connecting arm 102 includes a lateral arm 102A and a medial arm 102B, wherein both the lateral arm 102A and the medial arm 102B are arranged substantially in the lateral direction. The first part of the rigid heel structural element 100 extends from the upper rear portion 101 to the lower left direction in an arc-shaped manner, wherein the connecting arm 102 of the first part is connected with the upper rear portion 101 of the first part. As shown by the two arrows in FIG. 1C, the inner surface of the rigid heel structural element 100 has a certain thickness, and can be provided with a compressible layer, such as a foam cushioning element. The compressible layer can be affixed at the upper rear portion 101 of the rigid heel structural element 100 and at least a portion of the connecting arm 102.

Among others, the upper rear portion 101 is used to wrap the heel part of the foot. When the footwear strap is assembled to the footwear, the upper rear portion 101 extends in a direction from the position where the footwear contacts the heel toward the position where the footwear contacts the toe. As shown in FIS. 1GA-1C, the rigid heel structural element 100 extends from the upper rear portion 101 to the left in an arc-shaped manner. Meanwhile, when the footwear strap is assembled to the footwear, the upper rear portion 101 inclines downward along the direction from the position where the footwear contacts the heel toward the position where the footwear contacts the toe.

Among others, the downward inclined part of the upper rear portion 101 has a convex curvature 103, the convex face of which protrudes toward the foot when the footwear strap is assembled to the footwear. Further, the shape of the convex curvature 103 is adapted to the heel to facilitate easily receiving the heel part. The convex curvature 103 has an opening, and the lower portion of the opening of the convex curvature 103 faces the sole of the footwear when the footwear strap is assembled to the footwear.

In one embodiment, the convex curvature 103 has an upper surface that faces upward.

In one implementation, the rigid heel structural element 100 can be at least partially deformed instantly when the foot applies downward pressure on the rigid heel structural element 100. For example, the lateral arm 102A and the medial arm 102B can partially bend towards the rear of the footwear or bend outward to widen the opening of the footwear or both when the foot applies downward pressure on the rigid heel structural element 100. Due to the rigid, yet sufficiently elastic material used in the integrally molded rigid heel structural element 100, the rigid heel structural element 100 can restore to its original undeformed shape and position when the downward pressure applied by the foot is released.

In one embodiment, as shown in FIG. 1A, the rigid heel structural element includes two connecting arms 102, and each connecting arm 102 can include a medial arm 102B and a lateral arm 102A connected with the medial arm 102B. The connecting arm 102 can be connected to a vertical portion of the L-shaped anchor 104. A horizontal portion of the L-shaped anchor 104 is used to be connected with a footbed, an insole, or a strobel sock in the assembled state. The anchor can also be of various suitable shapes, such as J-shape and T-shape.

In one implementation, as shown in FIG. 1B, the rigid heel structural element includes two connecting arms 102, and each connecting arm 102 can include a medial arm 102B and a lateral arm 102A connected with the medial arm 102B. The connecting arm 102 is L-shaped. The end of the L-shape of the connecting arm 102 includes an upper surface and a lower surface, wherein the lower surface is at least partially connected to the top surface of the insole, and the upper surface is at least partially connected to the underside surface of the footbed.

In one implementation, when the footwear strap is assembled to the footwear, the lateral arm 102A and the medial arm 102B extend downward to the footbed, insole or strobel sock of the footwear.

In one implementation, when the lateral arm 102A and the medial arm 102B extend downward to the insole of the footwear, the lateral arm 102A is directly or indirectly affixed to the top surface of the sole along the medial side of the insole of the footwear; the medial arm 102B is directly or indirectly affixed to the top surface of the insole along the lateral side of the insole of the footwear.

In one implementation, when the lateral arm 102A and the medial arm 102B extend downward to the footbed of the footwear, the end of the lateral arm 102A and the end of the medial arm 102B can be attached to the footbed of the footwear through an anchor.

In one implementation, when the lateral arm 102A and the medial arm 102B extend downward to the strobel sock of the footwear, the end of the lateral arm 102A and the end of the medial arm 102B are attached to the strobel sock of the footwear.

In one implementation, the rigid heel structural element 100 is made of a polymer material.

In one implementation, the polymer material is Hytrel thermoplastic polyester elastomer block copolymer (such as DuPont Hytrel) or a Thermoplastic Polyurethane (TPU).

In one implementation, the rigid heel structural element 100 is covered by a fabric or textile material. Among others, the fabric and textile material can be the same as the textile material of the outer surface of the shoe.

Figure 3A:
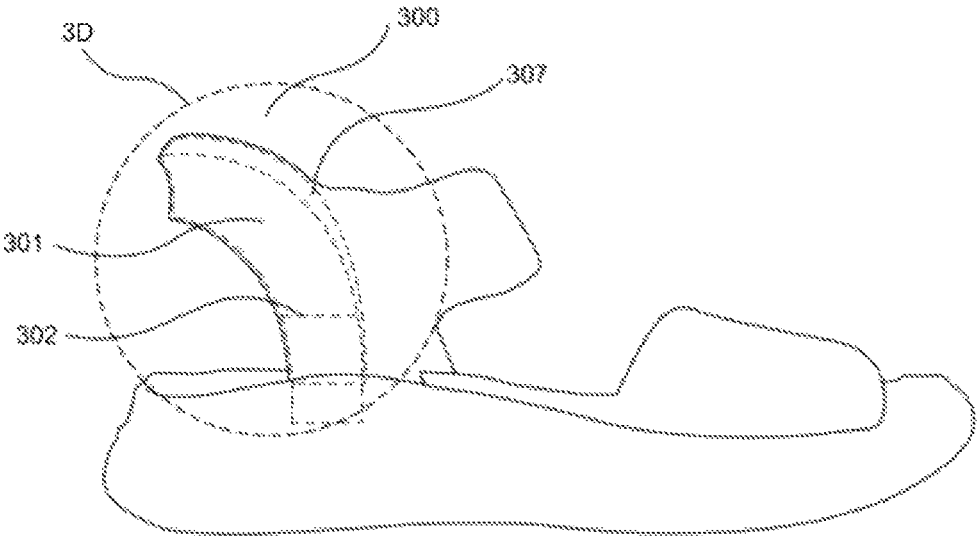
FIGS. 3A-3D are schematic diagrams showing the different structures obtained after the footwear strap according to an embodiment of the present application is assembled to the footwear respectively.
Figure 3B:
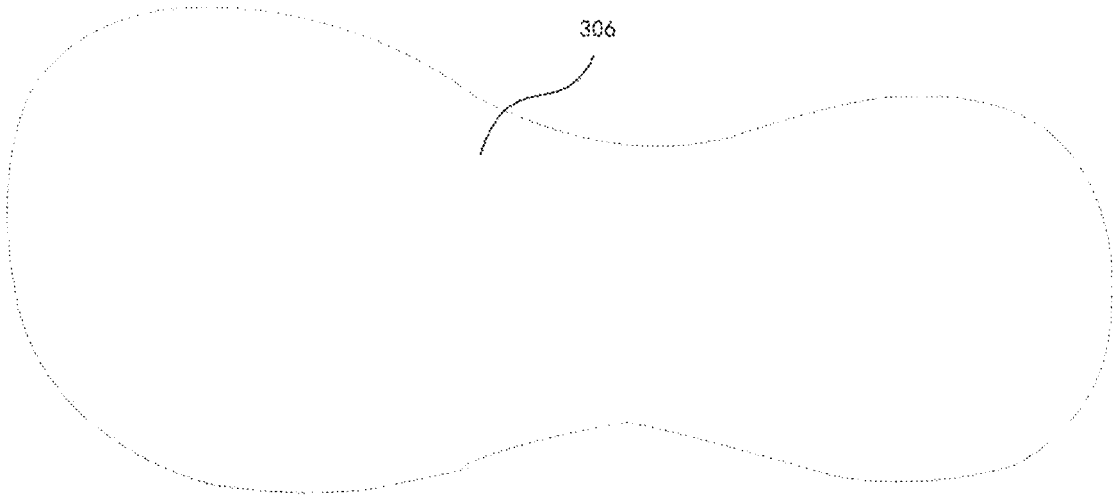
Figure 3C:
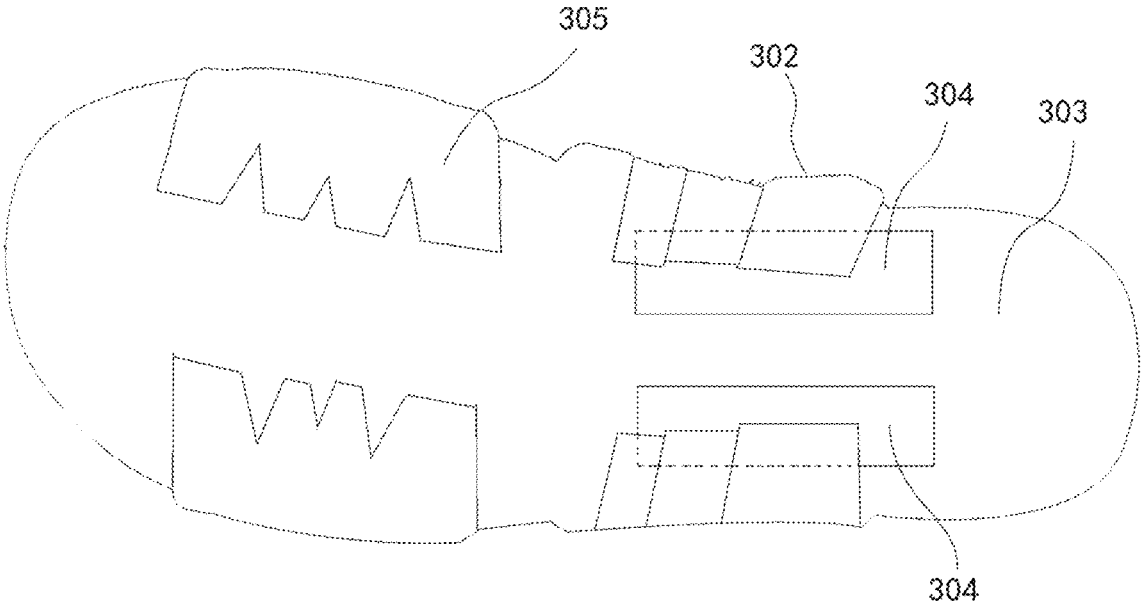
Figure 3D:
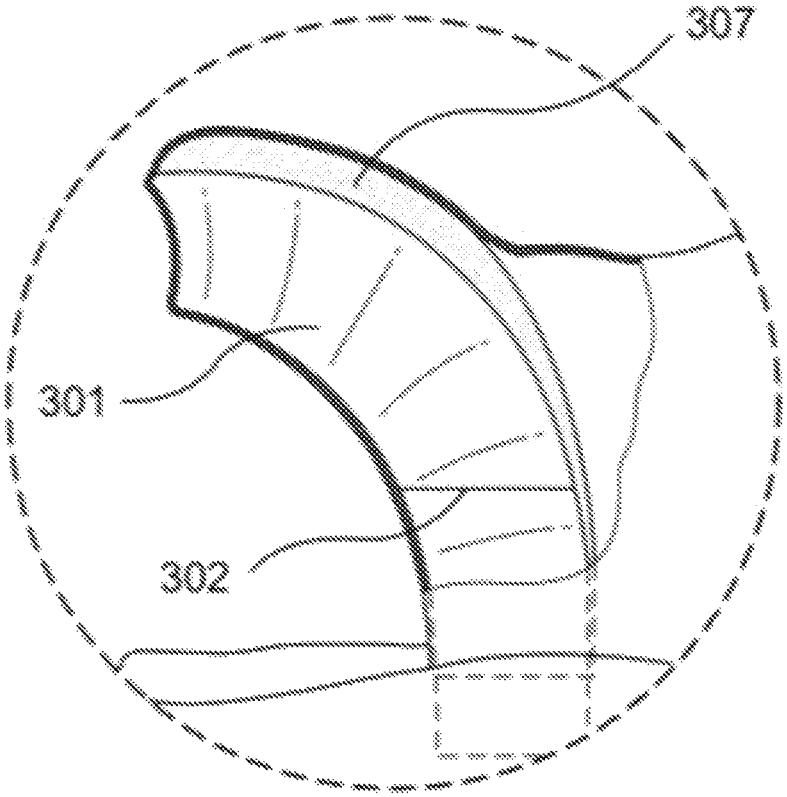
Figure 4:
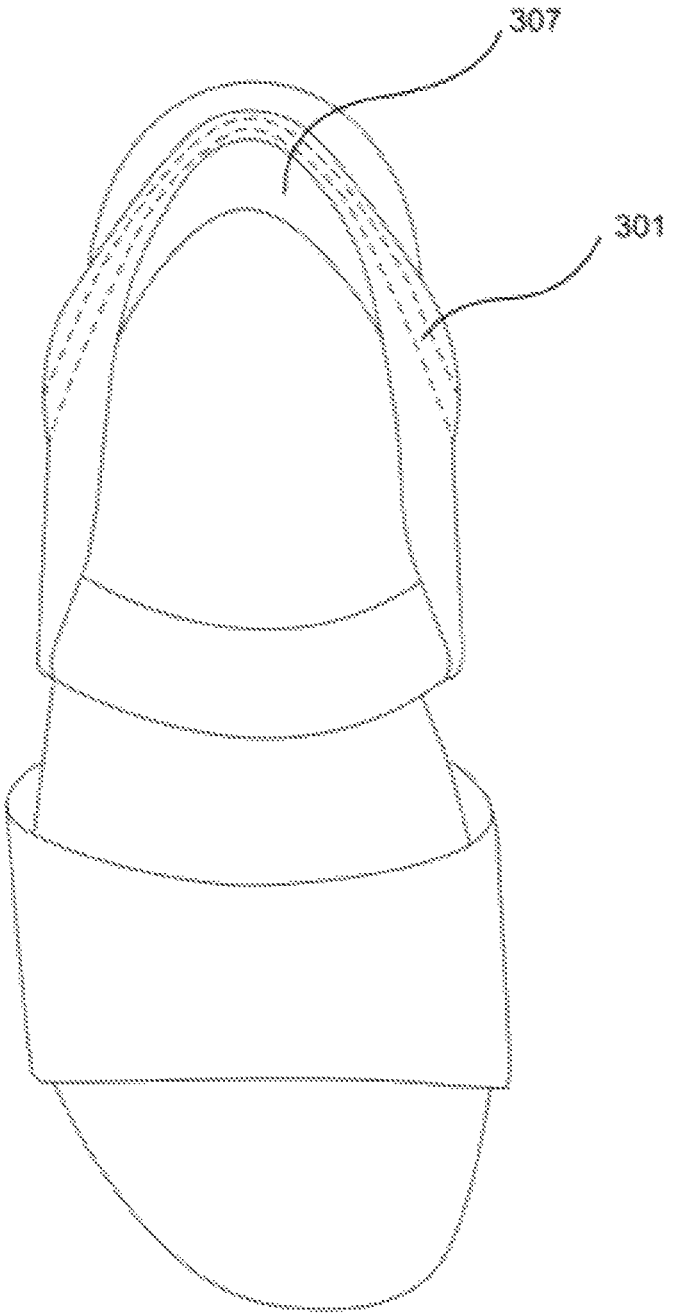
FIG. 4 shows a top view of an article of footwear with a footwear strap of the present application.

In one implementation, a compressible layer, such as compressible layer 307 shown in FIG. 3D and FIG. 4, is provided on the inner side of the rigid heel structural element 100. The compressible layer can be a foam cushioning element, affixed at the rear portion of the rigid heel structural element 100, and at least a portion of the inner side of the medial arm and the inner side of the lateral arm. The compressible layer covers the upper rear portion, partially covers the medial arm and the lateral arm, and gradually tapers or terminates along the inner side of the medial arm and the inner side of the lateral arm. The compressible layer can be compressed during the insertion of the foot into the footwear. After the foot is inserted into the footwear, the compressible layer can expand to its original uncompressed state or at least partially expand to its original uncompressed state. The compressible layer can be located around the ankle and assist in securing the foot within the footwear.

In the second aspect, in an embodiment of the present application, a footwear is further provided, comprising the footwear strap provided according to any embodiment of the present application.

In one implementation, a rigid heel structural element is connected to a footbed or insole of the footwear through an L-shaped anchor.

Figure 2:
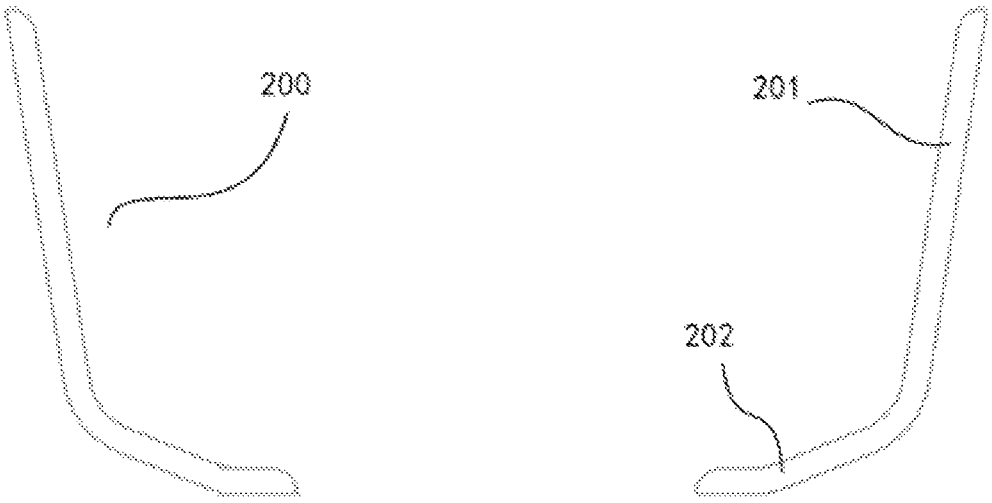
FIG. 2 shows a schematic diagram of a L-shaped anchor viewed from top perspective according to an embodiment of the present application.

FIG. 2 shows a schematic diagram of a L-shaped anchor 200 viewed from top perspective according to an embodiment of the present application; The L-shaped anchor 200 can be attached to the connecting arm 102 of the rigid heel structural element 100. The L-shaped anchor 200 can be molded separately. Referring to FIG. 2, the L-shaped anchor 200 can include a vertical portion 201 and a horizontal portion 202 depending on the L shape, wherein the vertical portion 201 corresponds to the long side of the L shape and the horizontal portion 202 corresponds to the short side of the L shape.

FIGS. 3A-3D are schematic views showing the different structures obtained after the footwear strap according to an embodiment of the present application is assembled in the footwear respectively. In one implementation, referring to FIG. 3A, in the assembled state, the connecting arm 301 of the footwear strap 300 is bonded to the vertical portion of the L-shaped anchor 302 in the assembled state, so as to secure the heel to the sandal shown in the figure. As shown in FIG. 3B, which is the bottom view of the footwear, the L-shaped anchor 302 is connected with the footbed or insole. The horizontal portion of the L-shaped anchor 302 is not shown, because the L-shaped anchor is covered by the sole 306. In one implementation, the connecting arm 301 of the footwear strap 300 is L-shaped. The L-shaped connecting arm 301 can be connected with the footbed or insole. As shown in FIG. 3B, which is the bottom view of the footwear, the L-shaped connecting arm 301 is connected to the footbed or insole. The L-shaped end of the L-shaped connecting arm 301 is not shown, because it is covered by the sole 306. FIG. 3D shows an enlarged cutaway view of the portion indicated in FIG. 3A. FIG. 4 shows a top view of an article of footwear with a footwear strap of the present application.

In an embodiment, as shown in FIG. 3C, the footwear can incorporate a pair of boards 304 affixed to the underside surface of the footbed or insole 303. The boards 304 can be further located on the medial and lateral sides of the footbed or insole 303 and spaced away from each other. The L-shaped anchor 302 can be connected to the boards 304. The boards 304 can be constructed of cellulose (such as texon). The bottom 305 of the sandal strap of the sandal shown in FIG. 3C can also be connected to the footbed or insole 303, or to the boards 304. The sole 306 as shown in FIG. 3B can be formed by covering the sole portion on the insole 303.

In another embodiment, the L-shaped anchor may be connected to a footbed, insole or strobel sock.

In an embodiment, the connecting arm 301 of the footwear strap 300 is L-shaped, and the L-shaped connecting arm 301 can be connected to the boards 304.

In another embodiment, the L-shaped connecting arm may be connected to a footbed, insole or strobel sock.

In the description of the present specification, it should be understood that, the orientation or positional relationships indicated by the terms "central", "vertical", "horizontal", "length", "width", "thickness", "upper", "lower", "front", "rear", "left", "right", "vertical", "horizontal", "top", "bottom", "inner", "outer", "clockwise", "counterclockwise", "axial", "radial", "circumferential", etc. are based on the orientation or positional relationships shown in the accompanying drawings and are only for facilitating the description of the present application and simplifying the description, rather than indicating or implying that the device or element referred to must have a particular orientation or be constructed and operated in a particular orientation, and therefore will not be interpreted as limiting the present application.

In addition, the terms "first" and "second" are only used for descriptive purposes, and cannot be understood as indicating or implying relative importance or implicitly indicating the number of indicated technical features. Therefore, the features defined with "first" and "second" can include one or more of these features explicitly or implicitly. In the description of the present application, the word "multiple" means two or more than two, unless otherwise specifically defined.

In the present application, unless otherwise specified and limited, terms "mounting", "connecting", "connection", "fix" and the like should be understood in a broad sense, for example, they can be a fixed connection, a detachable connection, or being integrated; can be a mechanical connection or an electrical connection; can be a direct connection or an indirect connection through a medium; and can be communication between interiors of two elements or interactive relationship of two elements. For those of ordinary skill in the art, the specific meaning of the terms mentioned above in the present application should be construed according to specific circumstances.

In the present application, unless otherwise specified and defined, the first feature being "on" or "under" the second feature can include that the first feature and the second feature are in direct contact, and can also include that the first feature and the second feature are not in direct contact but in contact with each other through another feature between them. Moreover, the first feature being "on", "above", and "over" the second feature includes that the first feature is directly above and obliquely above the second feature, or merely means that the first feature is horizontally higher than the second feature. The first feature being "underneath", "below", and "under" the second feature includes that the first feature is directly below and obliquely below the second feature, or merely means that the first feature is horizontally lower than the second feature.

The above disclosure provides many different implementations or examples to realize different structures of the present application. In order to simplify the disclosure of the present application, the components and arrangements of particular examples are described above. Of course, they are merely examples and are not intended to limit the present application. In addition, the present application can repeat reference numerals and/or reference letters in different examples. Such repetition is for the purpose of simplicity and clarity, and does not in itself indicate a relationship between the various implementations and/or arrangements discussed.

The above is only the detailed description of the present application, but the scope of protection of the present application is not limited thereto. Any person skilled in the art can readily conceive of various changes or substitutions within the technical scope disclosed in the present application, which should be encompassed by the scope of protection of the present application. Therefore, the scope of protection of the present application should be subject to the scope of protection of the claims.

What is claimed is:

1. An article of footwear comprising:

a strap element;

a heel structural element disposed inside the strap element;

the heel structural element comprising:

a medial arm and a lateral arm connected with the medial arm, the lateral arm and the medial arm being integrally molded, and the lateral arm being connected with an upper rear portion;

wherein the strap element is assembled to the footwear; and a compressible layer is provided on an inner side of the heel structural element, wherein the compressible layer entirely covers the upper rear portion, at least partially covers the medial arm and the lateral arm, and gradually tapers or terminates along the inner side of the medial arm and the inner side of the lateral arm.

2. The article of footwear according to claim 1 wherein the heel structure is rigid.

3. The article of footwear according to claim 1 wherein the lateral arm extends downward and is attached to an insole or a strobel sock of the footwear; and the medial arm extends downward and is attached to the insole or strobel sock of the footwear.

4. The article of footwear according to claim 1, wherein the heel structural element is made of a polymer material.

5. The article of footwear according to claim 4, wherein the polymer material is Hytrel thermoplastic polyester elastomer block copolymer or thermoplastic polyurethane.

6. The article of footwear according to claim 1, wherein the heel structural element is covered by a fabric, textile material, leather, or polymer plastic.

7. The article of footwear according to claim 1, wherein the lateral arm extends downward toward a sole of the footwear and is directly or indirectly affixed to the top surface of the sole along a lateral side of the sole of the footwear; and the medial arm extends downward toward the sole of the footwear and is directly or indirectly affixed to the top surface of the sole along the medial side of the sole of the footwear.

8. The article of footwear according to claim 1, wherein when the lateral arm and the medial arm extend downward to a footbed of the footwear, an end of the lateral arm and an end of the medial arm are attached to the footbed of the footwear.

9. The article of footwear according to claim 1, wherein when the lateral arm and the medial arm extend downward to a strobel sock of the footwear, an end of the lateral arm and an end of the medial arm are attached to the strobel sock of the footwear.

10. The article of footwear according to claim 1, wherein the heel structural element is configured to be at least partially deformed when a downward pressure is applied by the foot, such that the medial and lateral connecting arms can partially bend towards the rear of the footwear or outward to widen the opening of the footwear or both.

11. The article of footwear according to claim 1, wherein the upper rear portion comprises a convex curvature oriented toward a front of the article of footwear.

12. The article of footwear according to claim 11, wherein the convex curvature further comprises an upward-facing surface, and the convex curvature extends from a top edge to a bottom edge of the upper rear portion in a cross section taken along a vertical plane along a longitudinal axis.

13. An article of footwear comprising:

a strap element;

a heel structural element disposed inside the strap element;

the heel structural element comprising:

an upper rear portion;

a medial connecting arm extending medially from the upper rear portion;

a lateral connecting arm extending laterally from the upper rear portion; and a compressible layer provided on an inner side of the heel structural element, wherein the compressible layer entirely covers the upper rear portion, ag least partially covers the medial connecting arm and the lateral connecting arm, and gradually tapers or terminates along the inner side of the medial connecting arm and the inner side of the lateral connecting arm.

14. The article of footwear according to claim 13 wherein the heel structure is rigid.

15. The article of footwear according to claim 13 wherein the upper rear portion comprises a downward incline from a top edge of the upper rear portion toward the front of the footwear.

16. The article of footwear according to claim 13 wherein at least one of the medial connecting arm and lateral connecting arm extends vertically from one end, and curves rearward towards the rear of the footwear, forming an arcuate shape in a side projection.

17. The article of footwear according to claim 13 wherein the lateral arm extends downward and is attached to an insole or a strobel sock of the footwear; and the medial arm extends downward and is attached to the insole or strobel sock of the footwear.

18. The article of footwear according to claim 13, wherein the lateral arm extends downward toward a sole of the footwear and is directly or indirectly affixed to a top surface of the sole along a lateral side of the sole of the footwear; and the medial arm extends downward toward the sole of the footwear and is directly or indirectly affixed to the top surface of the sole along the medial side of the sole of the footwear.

19. The article of footwear according to claim 13, wherein when the lateral arm and the medial arm extend downward to a footbed of the footwear, the end of the lateral arm and the end of the medial arm are attached to the footbed of the footwear.

20. The article of footwear according to claim 13, wherein the heel structural element is configured to be at least partially deformed when a downward pressure is applied by the foot, such that the medial and lateral connecting arms can partially bend towards the rear of the footwear or outward to widen the opening of the footwear or both.

21. The article of footwear according to claim 13, wherein the upper rear portion comprises a convex curvature oriented toward a front of the article of footwear, and the convex curvature extends from a top edge to a bottom edge of the upper rear portion in a cross section taken along a vertical plane along a longitudinal axis.

22. An article of footwear comprising:

a strap element;

a heel structural element disposed inside the strap element;

the heel structural element comprising:

an upper rear portion;

a medial connecting arm extending medially from the upper rear portion;

a lateral connecting arm extending laterally from the upper rear portion;

a compressible layer provided on an inner side of the heel structural element, wherein the compressible layer entirely covers the upper rear portion, at least partially covers the medial connecting arm and the lateral connecting arm, and gradually tapers or terminates along the inner side of the medial connecting arm and the inner side of the lateral connecting arm;

the upper rear portion having a first surface oriented toward a front of the article of footwear and a second surface oriented toward a rear of the article of footwear;

the upper rear portion having a top edge and a bottom edge in a cross section taken along a vertical plane along a longitudinal axis; and the first surface is continuously convex from the top edge to the bottom edge.

* * * * *